US008727790B1

(12) United States Patent
Bishop

(10) Patent No.: US 8,727,790 B1
(45) Date of Patent: May 20, 2014

(54) BOARD-TO BOARD CONNECTORS WITH INTEGRAL DETACHABLE TRANSFER CARRIER PLATE

(71) Applicant: AVX Corporation, Fountain Inn, SC (US)

(72) Inventor: Peter Bishop, Cambs (GB)

(73) Assignee: AVX Corporation, Fountain Inn, SC (US)

( * ) Notice: Subject to any disclaimer, the term of this patent is extended or adjusted under 35 U.S.C. 154(b) by 30 days.

(21) Appl. No.: 13/666,405

(22) Filed: Nov. 1, 2012

(51) Int. Cl.
*H01R 13/02* (2006.01)

(52) U.S. Cl.
USPC ..... 439/65; 439/940

(58) Field of Classification Search
USPC ..... 439/66, 61, 62, 65, 59, 76.1, 79, 885, 439/940
See application file for complete search history.

(56) References Cited

U.S. PATENT DOCUMENTS

| | | | | |
|---|---|---|---|---|
| 3,181,101 | A * | 4/1965 | Fox | 439/79 |
| 4,657,320 | A * | 4/1987 | Bamford et al. | 439/31 |
| 4,721,355 | A | 1/1988 | Gould | |
| 4,726,793 | A * | 2/1988 | Bright | 439/751 |
| 5,194,018 | A | 3/1993 | Lopata et al. | |
| 5,199,889 | A * | 4/1993 | McDevitt, Jr. | 439/66 |
| 5,373,626 | A * | 12/1994 | Youngfleish | 29/739 |
| 6,155,863 | A | 12/2000 | Matsuzaki et al. | |
| 7,874,845 | B1 * | 1/2011 | Tang et al. | 439/65 |
| 8,162,678 | B2 * | 4/2012 | Wang | 439/78 |
| 8,172,596 | B2 | 5/2012 | Siebens | |
| 8,382,322 | B2 * | 2/2013 | Bishop | 362/249.02 |
| 2010/0015836 | A1 * | 1/2010 | Zhu | 439/329 |
| 2010/0136826 | A1 * | 6/2010 | Zhu | 439/571 |
| 2010/0294546 | A1 * | 11/2010 | Nickel et al. | 174/255 |
| 2012/0184126 | A1 * | 7/2012 | Chen et al. | 439/345 |
| 2012/0294011 | A1 * | 11/2012 | Cattoni et al. | 362/311.02 |

* cited by examiner

*Primary Examiner* — Neil Abrams
*Assistant Examiner* — Phuongchi T Nguyen
(74) *Attorney, Agent, or Firm* — Foley & Lardner LLP

(57) ABSTRACT

An electrical connector assembly for mounting to contact pads on a printed circuit board (PCP) includes a carrier plate. A first connector component and a second connector component are attached to the carrier plate. The first and second connector components are spaced apart on the carrier plate a distance corresponding to spacing of the contact pads on the PCB. A frangible connection is defined between each of the first and second connector components and the carrier plate such that after mounting the connector assembly to the PCB, the carrier plate is detached from the first and second connector components.

13 Claims, 5 Drawing Sheets

BOARD-TO BOARD CONNECTORS WITH INTEGRAL DETACHABLE TRANSFER CARRIER PLATE

FIELD OF THE INVENTION

The present invention relates generally to the field of electrical connectors, and more particularly to board-to-board connectors.

BACKGROUND

Various types of electrical connectors are known in art for interconnecting board components (e.g., printed circuit boards ("PCB's")) in an edge-to-edge arrangement. Reference is made, for example, to the Series 9159 horizontal socket board-to-board connectors from AVX Corp. This series of surface mount connectors are offered in a 2-way through a 6-way configuration, and are particularly suited for abutting, coplanar connection of PCB's. A plug component with a horizontal plug having first contacts molded therein is surface mounted to an edge of a first board, while a socket component having a matching number of contacts is surface mounted to an edge of a second board. During the surface mounting process, the respective components are aligned over contact pads on the PCB with conventional pick-and-place (i.e., vacuum transfer) equipment and subsequently soldered to the board.

Many board-to-board applications do not need or cannot accommodate a multi-way connector (e.g., because of limited board space), and multiple single-way connectors are used. This single-way connector configuration, however, is not without drawbacks. The single-way connector body (molding) is often too small of a surface for adequate attachment by the suction nozzle of the pick-and-place machine and other more tedious and time-consuming placement techniques must be used. Precise alignment and orientation of the single-way components to ensure mating connection between adjacent PCB's is also problematic.

U.S. Pat. No. 6,155,863 proposes a solution for increasing the surface area of a multi-way connector component to a size sufficient for attachment of a vacuum transfer nozzle wherein a frangible hermetic seal is placed over an opening in the connector housing so that the nozzle can draw a suction on the respective seal surface. Once the component has been mounted, the seal is broken and the opening becomes free for engagement by a mating component. This proposal is not, however, suitable for single-way connectors.

Accordingly, a need exists for an improved single-way connector assembly that is suitable for conventional vacuum transfer mounting processes on a PCB.

SUMMARY OF THE INVENTION

Objects and advantages of the invention will be set forth in part in the following description, or may be obvious from the description, or may be learned through practice of the invention.

In accordance with certain aspects of the invention, an electrical connector assembly is provided for mounting to contact pads on a printed circuit board (PCP). Each assembly provides one or more parts of separate electrical connectors that mate with complimentary parts on an adjacent PCB to form a complete electrical connector. In a particular embodiment, the assembly includes a carrier plate of any suitable shape or geometry that provides an upper surface with sufficient surface area for a pick-and-place operation wherein a suction nozzle of a vacuum transfer device used to move and orient the assembly to the contact pads on the PCB. A first connector component is attached to the carrier plate. In a particular embodiment, a second connector component is also attached to the carrier plate. The first and second connector components are spaced apart on the carrier plate a distance corresponding to spacing of the contact pads on the PCB. A frangible connection is defined between each of the first and second connector components and the carrier plate such that after mounting the connector assembly to the PCB, the carrier plate is readily detached (e.g., broken away) from the first and second connector components.

In certain embodiments, each of the first and second connector components includes an insulative base body, with the frangible connection defined by a weakened material line between the carrier plate and the insulative base bodies. The term "weakened material line" is meant to encompass any type of scored, perforated, thinned, or other physical deformation or characteristic in the material between the carrier plate and the insulative base bodies that allows the carrier plate to be readily detachable from the based bodies in a manual or automated process. For example, the carrier plate may be bent, pulled, twisted, or otherwise manipulated relative to the mounted base bodies to detach the plate from the base bodies.

In a unique embodiment, the carrier plate and the insulative base bodies are molded as a single component, with the weakened material line formed in the molding process.

The carrier plate may be variously configured. For example, the carrier plate may include a generally L-shaped member with a first leg defining an upper surface having a surface area sufficient for attachment of a suction nozzle of a vacuum transfer device, and a second leg extending transversely to the insulative base bodies.

It should be appreciated that the assembly is not limited by the design of the connector components. In one embodiment, each of the first and second components are a component of different respective single way connector when mated with complimentary second and first components on an adjacent PCB. Thus, in this embodiment, the connector assembly provides separate components of two (or more) different single way connectors.

The first connector component may be a socket component of a single way connector, with the second connector component being a complimentary plug component. The socket component may include an insulative base body having an internal receipt channel defined therein, with a first electrical contact held in the receipt channel. A section of the first electrical contact at a bottom surface of the insulative body may be disposed for mounting to a contact pad on the PCB. The frangible connection is defined between the insulative base body and the carrier plate.

The plug component may include an insulative base body with a plug member extending transversely therefrom. A second electrical contact extends onto the plug member with a section at a bottom surface of the insulative base body for mounting to a different contact pad on the PCB. The frangible connection is defined between the insulative base body and the carrier plate. The socket and plug components may include surface mounting brackets configured at the respective bottom surface thereof.

In certain embodiments, the first electrical contact in the socket component may be spring biased in the receipt channel. For example, the first electrical contact may be a generally U-shaped contact with a biased section defined by a leg of said U-shaped contact that extends through an opening in the insulative base body to the bottom surface of the insulative base body.

The second electrical contact in the plug component may extend from a bottom surface of the insulative base body through an opening in a side wall of the insulative base body where the plug member extends from the side wall and extend along the plug member.

In desirable embodiments, the first and second electrical contacts are molded into the respective insulative base body of the plug and socket components.

It should be appreciated that the present invention is not limited of any particular number of separate connector components attached to a common carrier plate, and encompasses embodiments wherein, for example, only a single connector component is attached to a carrier plate. Other embodiments may include three or more separate connector components attached to a common carrier plate.

Aspects of the invention are presented below by reference to particular embodiments illustrated in the figures.

DETAILED DESCRIPTION

Figure 1:
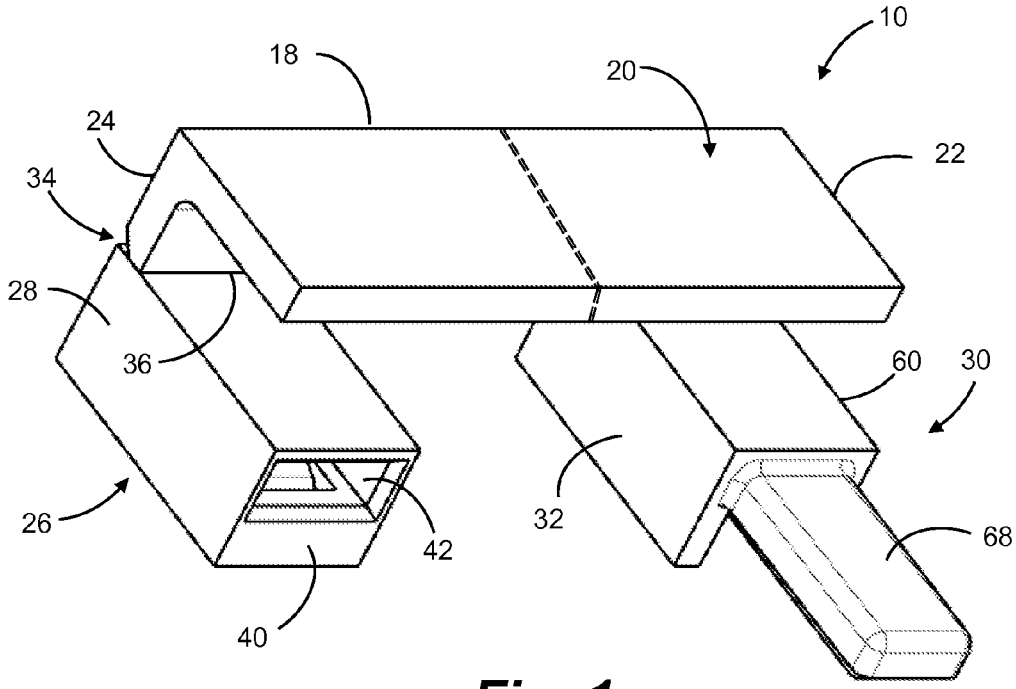
FIG. 1 is a perspective view of an embodiment of a connector assembly in accordance with aspects of the invention.

Reference will now be made in detail embodiments of the invention, examples of which are illustrated in the drawings. The various embodiments are presented herein for sake of explaining aspects of the invention, and should not be interpreted as a limitation of the invention. For example, features illustrated or described with respect to one embodiment can be used with another embodiment to yield still a further embodiment. It is intended that the present invention include these and other modifications and variations as come within the scope and spirit of the invention.

Figure 2:
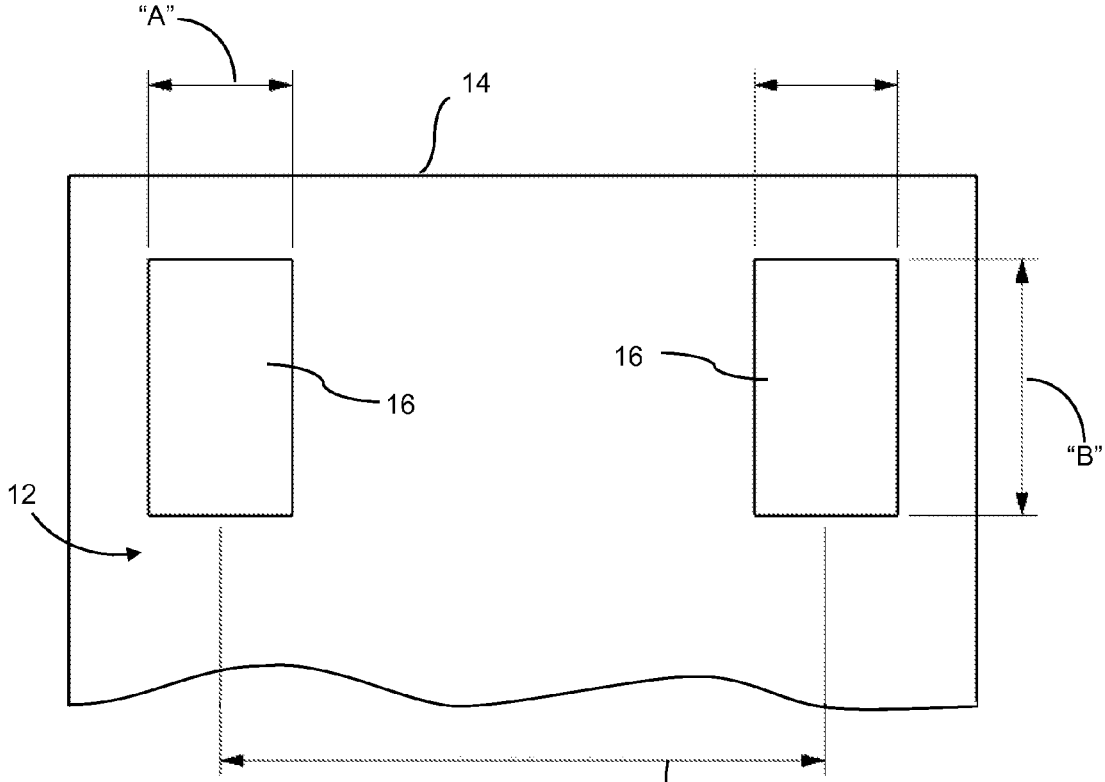
FIG. 2 is a top view of an exemplary PCB illustrating the contact pads.

As described above, embodiments of an electrical connector assembly are provided for mounting to contact pads on a printed circuit board (PCP). FIG. 2 depicts an exemplary PCB 12 having any number of contact pads 16 (having a width "A" and length "B") set at a defined spacing "C" (pitch) and pattern ("footprint") along one end 14 of the board 12. The connector assembly is not limited to any particular type or configuration of PCB. Each assembly provides one or more parts of separate electrical connectors that are mounted to the pads 16 for electrical mating with complimentary parts on an adjacent PCB to form a complete electrical connector between abutting edges of the PCB's. In this regard, the complete connectors may be consider as "edge connectors" or "board-to-board" connectors as is generally understood in the art.

Referring to FIG. 1, an embodiment 10 of a connector assembly is depicted. The assembly 10 includes a carrier plate 18 defining an upper "pick-up" surface 20 that has a sufficient surface area for attachment of a suction nozzle of a conventional vacuum transfer device used in the industry for transferring components for mounting to the PCB in a pick-and-place process. The surface 20 may have any shape or configuration and is depicted in the figures as a generally rectangular surface for sake of illustration.

The carrier plate 18 may be variously configured. In the illustrated embodiment, the carrier plate 18 is a generally L-shaped member having a first or upper leg 22 defining the pick-up surface 20, and a second or transverse leg 24.

One or more connector components are attached to the carrier plate 18. In the embodiment depicted in FIG. 1, a first connector component 26 and a second connector component 30 are attached to the common carrier plate 18. It should be appreciated that the assembly 10 is not limited by the number of connector components attached to the carrier plate 18. For example, the invention contemplates a single connector component attached to a carrier plate 18, as depicted by the dashed line along the carrier plate 18 in FIGS. 1 and 4. Thus, in one embodiment, the assembly 10 may include a carrier plate 18 with a single first connector component 26 attached thereto. A different embodiment may include a carrier plate 18 with a single second connector component 30 attached thereto.

It should be appreciated that the connector assembly 10 is not limited by the design of the connector components 26, 30. In one embodiment, each of the first 26 and second 30 components are a component of different respective single-way connector 38 (FIG. 3) when mated with complimentary second 30 and first 26 components of an adjacent PCB 12. Thus, in this embodiment, the connector assembly 10 provides separate components of two (or more) different single-way connectors 38.

Figure 3:
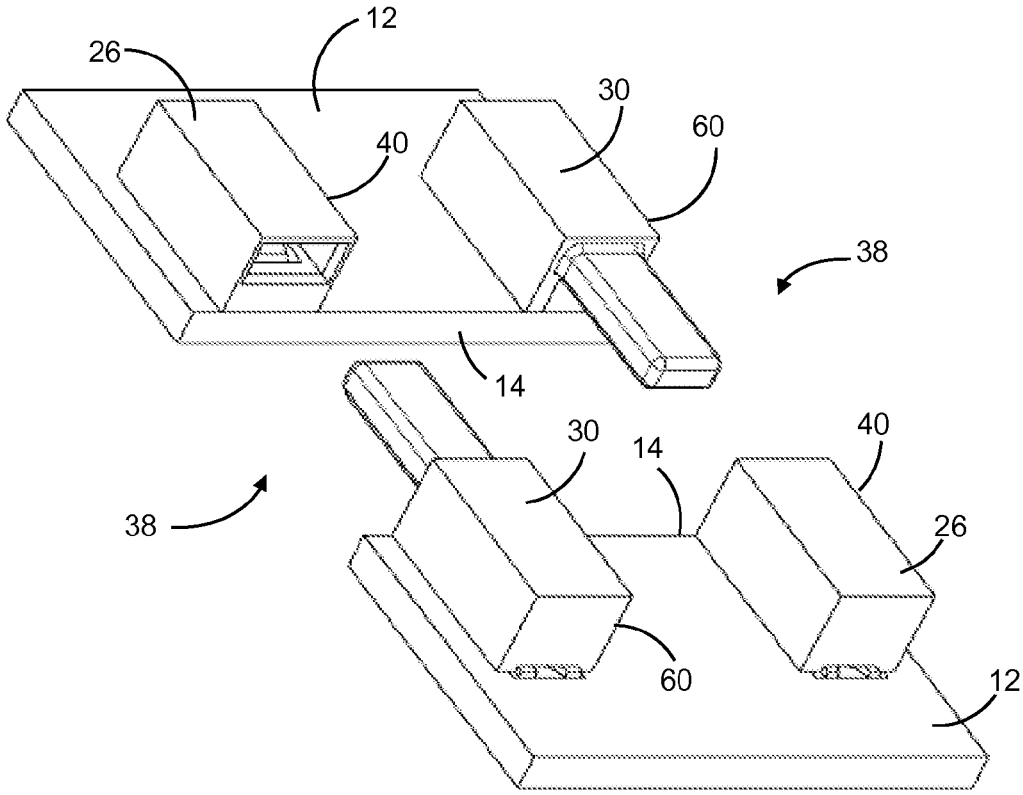
FIG. 3 is a perspective view of the electrical components from two separate connector assemblies attached to ends of abutting PCB's to define two separate single-way electrical connectors between the PCB's.
Figure 4:
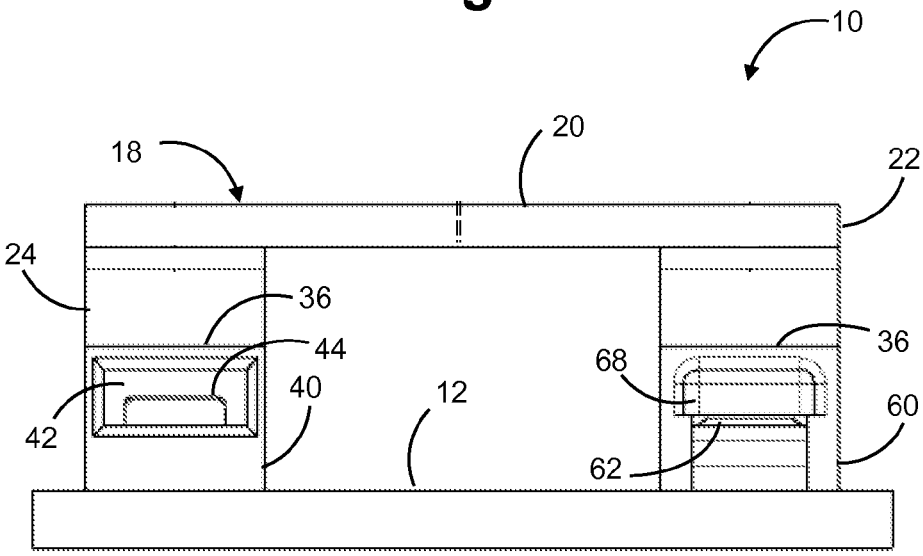
FIG. 4 is a front view of a connector assembly mounted on a PCB before detachment of the carrier plate.
Figure 9:
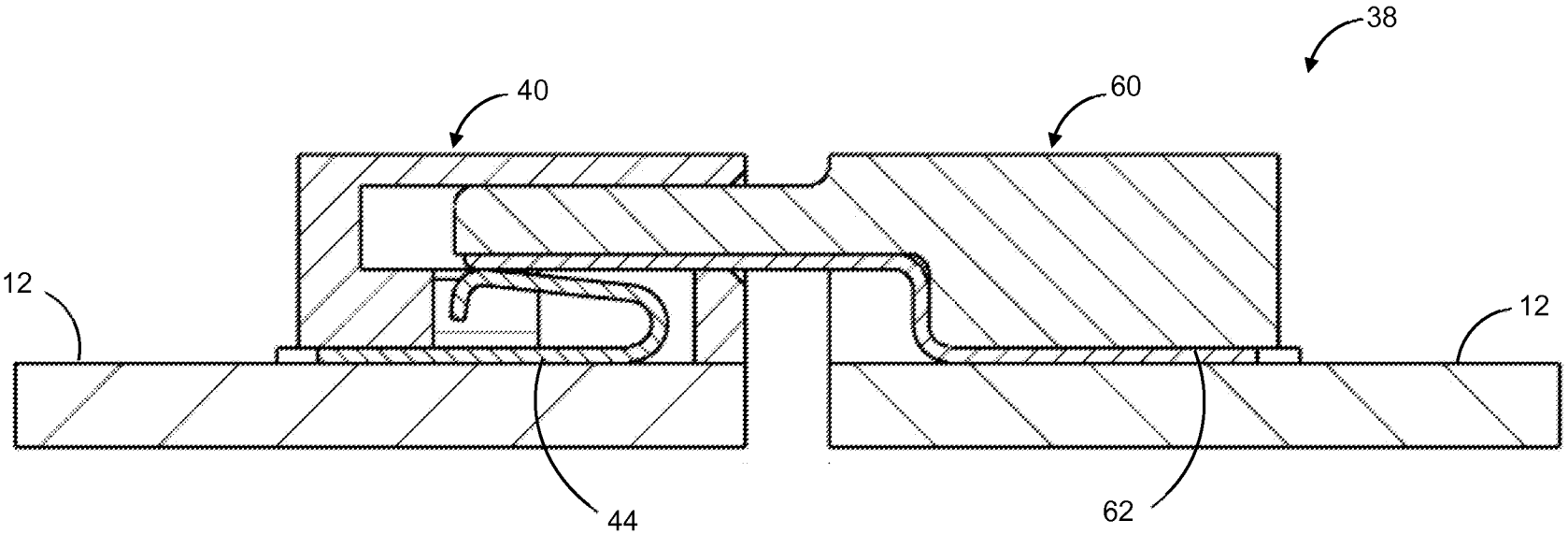
FIG. 9 is a cross-sectional view of the mated components of FIGS. 5 and 7.

Referring to FIGS. 1 through 4, the first and second connector components 26, 30 are spaced apart on the carrier plate 18 a distance corresponding to spacing or pitch "C" of the contact pads 16 on the PCB 12. A frangible connection 34 is defined between each of the first and second connector components 26, 30 and the carrier plate 18 such that after mounting the connector assembly 10 to the PCB 12 as depicted in FIG. 4 in any conventional surface mount process, the carrier plate 18 is subsequently and readily detached (e.g., broken away) from the first and second connector components 26, 30, resulting in the arrangement depicted in FIG. 3 wherein components of two separate single-way electrical connectors 38 are fixed to the PCB 12. A separate assembly 10 may provide complimentary connector components 26, 30 to the adjacent PCB 12 (as depicted in FIG. 3), wherein the components are subsequently mated as depicted in FIG. 9 to electrically connect the PCB's 12.

Each of the first and second connector components 26, 30 includes an insulative base body 28, 32, respectively, that is attached to the carrier plate 18 via a frangible connection 34 (FIG. 1). This frangible connection 34 may be variously defined. For example, in the illustrated embodiment, the connection 34 is defined by a weakened material line 36 at the juncture of the carrier plate 18 and the insulative base bodies 28, 32. The carrier plate 18 and base bodies 28, 32 are desirably co-molded as a single molded component, and the term "weakened material line" is meant to encompass any type of scored, perforated, thinned, or other physical deformation or characteristic in the material between the carrier plate 18 and the insulative base bodies 28, 32 that allows the carrier plate 18 to be readily detachable from the base bodies 28, 32 in a manual or automated process. For example, the carrier plate 18 may be bent, pulled, twisted, or otherwise manipulated relative to the mounted base bodies 28, 32 to detach the plate from the base bodies. The weakened material line 36 may be formed in the molding process, or may be subsequently formed in the molded material.

It should be appreciated that the connector components 26, 30, can take on various configurations while serving to interconnect adjacent boards 12 in a direct abutting end-to-end configuration. In the illustrated embodiments of the connector assembly 10, the first connector component 26 is a socket component 40 and the second connector component 30 is a plug component 60. Mounting of the socket component 40 and plug component 60 on facing ends 14 of adjacent boards 12 is particularly illustrated in FIG. 3. With this unique two-part, single-way, socket and plug component connector 38, the plug component 60 of a first board 12 engages into the socket component 40 of a second board 12 to electrically connect the first and second PCB's 12 in an abutting end-to-end configuration, as depicted in FIG. 9.

Figure 5:
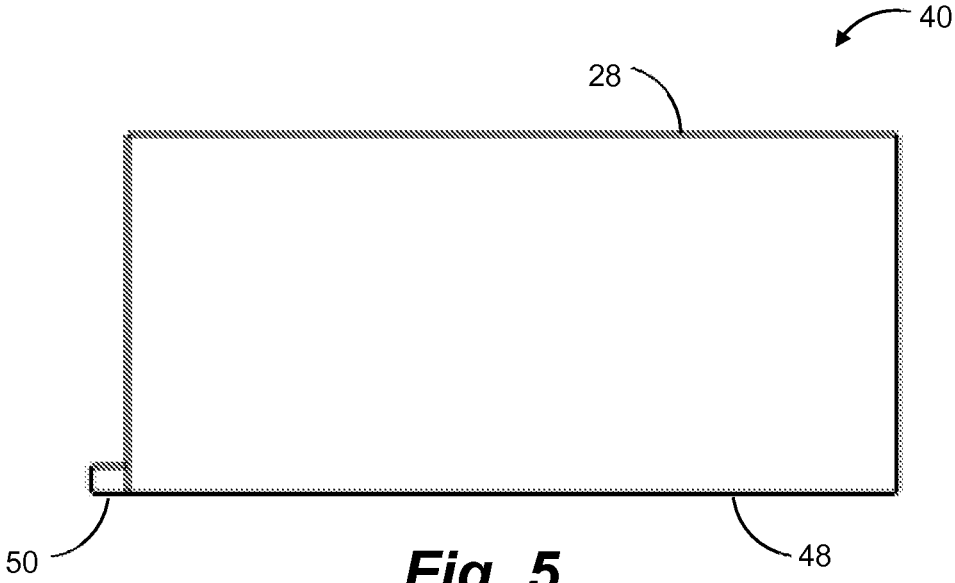
FIG. 5 is a side view of an exemplary connector component in the form of a socket component.
Figure 6:
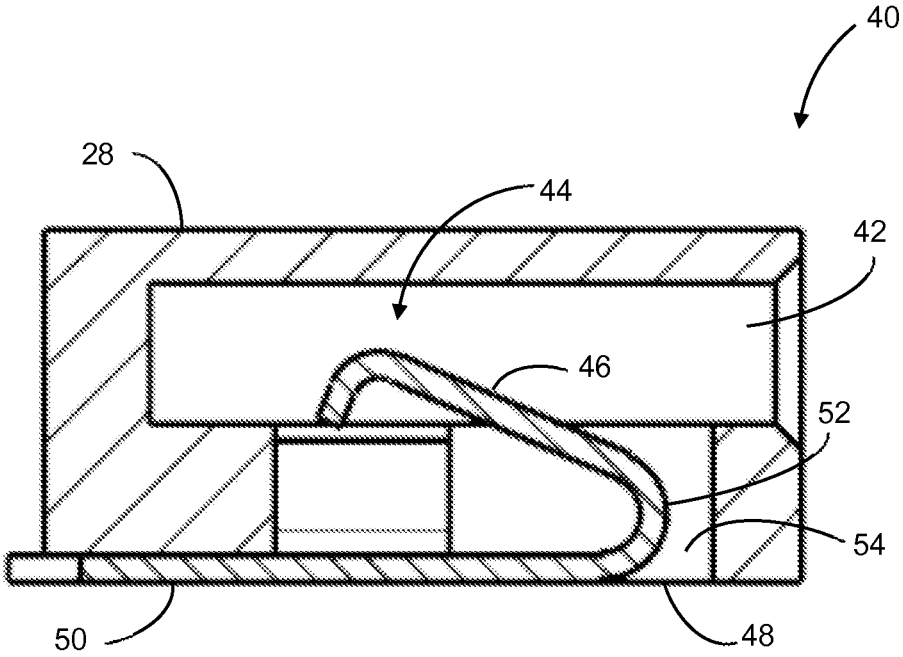
FIG. 6 is a cross-sectional view of the socket component of FIG. 5.

In one embodiment as illustrated in the figures (particularly FIGS. 5 and 6), the socket component 40 includes an insulative base body 28 having an internal receipt recess or channel 42 defined therein. The insulative body 28 can take on various shapes and sizes, and is generally formed of any suitable insulative material, such as nylon-46. Other insulative materials are well known to those skilled in the art and may be used in the components of a connector assembly 10 24 of the present invention.

An electrical contact 44 is held in the body 28 of the socket component 40. Any number of contacts 44 may be configured in the body 28 depending on the desired contact footprint (i.e., a 2-way, 3-way, 4-way contact, and so forth). The contact 44 has a section 50 disposed at a bottom surface 48 of the body 28 that engages against the contact pad 16 on the board 12. The contact 44 includes a second section 46 that extends into the internal receipt channel 42, as particularly illustrated in FIG. 2B. This section 46 may be spring biased in the receipt channel 42 as the result of a bend 52 in the contact 44. For example, in the illustrated embodiment, the contact 44 is a generally U-shaped strip member with the first section 50 of the contact 44 being defined by one of the legs of the U-shaped member that extends through an opening or slot 54 in the body 28 near the bottom surface 48 of the body 28. The other leg of the U-shaped contact 44 is defined by the bend 52 and extends into the receipt channel 42, with the bend 52 imparting a degree of spring or resiliency to the section 46. The U-shaped contact 44 may bend around a post or portion of the body 28, or the contact 44 may be retained in slots or other engaging structure defined in any portion of the body 28. It should be readily appreciated that any suitable means may be employed to retain the contact 44 within the body 28. For example, the contact 44 may be molded into the body 28, or retained by any mechanical means.

Figure 7:
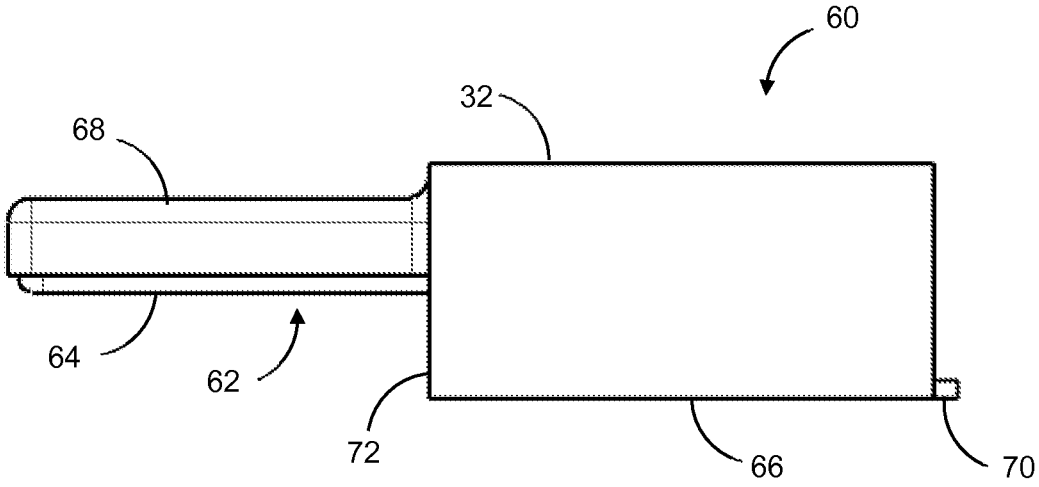
FIG. 7 is a side view of an exemplary connector component in the form of a plug component.
Figure 8:
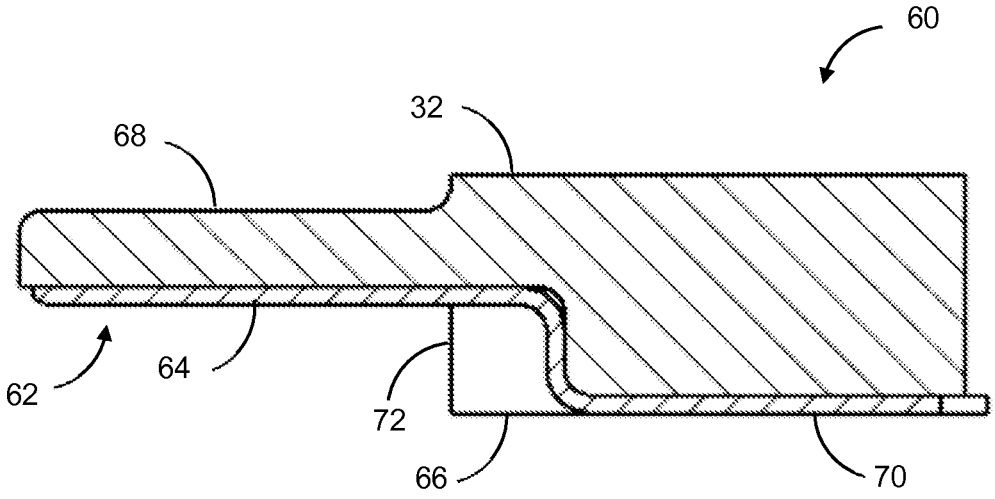
FIG. 8 is a cross-sectional view of the plug component of FIG. 7.

The plug component 60 may include an insulative base body 32 having at least one electrical contact 62 retained thereby. The contact 62 may have a section 70 disposed at a bottom surface 66 of the body 32 (FIGS. 7 and 8) for attachment to a contact pad 16 on the PCB 12, as particularly illustrated in FIG. 9. The plug component 60 may include any manner of extension or plug member 68 that extends transversely from the base body 32 beyond the end of the PCB 12, which relationship is particularly illustrated in FIG. 3. The electrical contact 62 has a second section 64 that extends at least partially onto the plug member 68, as illustrated in FIG. 8. For example, the electrical contact 62 may extend through an opening in a side wall 72 of the base body 32 generally at a location where the plug member 68 extends transversely from the side wall 72. A portion of the contact defining the section 70 may extend out of an opening in the bottom 66 of the body 32. Thus, the contact 62 may include any number of bends to accommodate this configuration within the body 32 and along the plug member 68. As with the socket component 40, the contact 62 may be retained in the plug component 60 by any suitable means. For example, the contact 62 may be molded directly into the plug component body 32, or retained by any suitable mechanical means.

Referring to FIGS. 3 and 9, it is readily appreciated that for mating electrical connection between adjacent PCB's 12, the plug member 68 of a plug component 60 on one end of a first board 12 slides into the receipt channel 42 in the socket component 40 mounted to the end of an adjacent board 12. The section 64 of the contact 62 exposed on the plug member 68 along the bottom surface of the plug member engages in sliding frictional contact with the biased section 46 of the contact 44 in the socket component 40, which faces upward in the channel 42.

The socket 40 and plug 60 components may be retained on the top surface of the PCB's 12 by any suitable surface mount technology known or practiced in the art.

It should be readily appreciated that the connector assembly 10 described herein is not limited in any way to a particular construction material. In a desirable embodiment, the various contacts may be, for example, copper alloy with selective gold over nickel tin plated on the contact tails. The insulative body components may be, for example, nylon-46.

It should be readily appreciated by those skilled in the art that various modifications and variations can be made to the present invention without departing from the scope and spirit of the invention as set forth in the claims and their equivalents.

What is claimed is:

1. An electrical connector assembly for mounting to contact pads on a printed circuit board (PCP), said connector assembly comprising:

a carrier plate:

a first connector component attached to said carrier plate:

a second connector component attached to said carrier plate;

said first and second connector components spaced apart on said carrier plate a distance corresponding to spacing of the contact pads; and a frangible connection between each of said first and second connector components and said carrier plate such that after mounting said connector assembly to the PCB, said carrier plate is detached from said first and second connector components;

wherein each of said first and second connector components comprises an insulative base body, said frangible connection comprising a weakened material line between said carrier plate and said insulative base bodies;

wherein said carrier plate and said insulative base bodies are molded as a single component.

2. The connector assembly as in claim 1, wherein said carrier plate comprises a generally L-shaped member with a first leg defining an upper surface with a surface area sufficient for attachment of a suction nozzle of vacuum transfer device, and a second leg extending transversely to said insulative base bodies.

3. The connector assembly as in claim 1, wherein each of said first and second components are a component of different respective single way connectors when mated with complimentary said second and first components of an adjacent PCB, such that said connector assembly provides separate components of two different single way connectors.

4. The connector assembly as in claim 1, wherein said first connector component is a socket component, and said second connector component is a plug component.

5. The connector assembly as in claim 4, wherein said socket component comprises an insulative base body having an internal receipt channel defined therein, and a first electrical contact held in said receipt channel with a section of said first electrical contact at a bottom surface of said insulative base body for mounting to a contact pad on the PCB, said frangible connection defined between said insulative base body and said carrier plate, said plug component comprising an insulative base body with a plug member extending transversely therefrom and a second electrical contact extending onto said plug member with a section of said second electrical contact at a bottom surface of said insulative base body for mounting to a contact pad on the PCB, said frangible connection defined between said insulative base body and said carrier plate.

6. The connector assembly as in claim 5, wherein said second electrical contact in said plug component extends from a bottom surface of said insulative base body through an opening in a side wall of said insulative base body where said plug member extends from said side wall and along said plug member.

7. The connector assembly as in claim 5, wherein said first and second electrical contacts are molded into said respective insulative base body of said socket component and said plug component.

8. The connector assembly as in claim 5, wherein said first electrical contact is spring biased in said receipt channel of said socket component.

9. The connector assembly as in claim 8, wherein said first electrical contact in said socket component is generally U-shaped contact with a biased section defined by a leg of said U-shaped contact that extends through an opening in said insulative base body to said bottom surface of said insulative base body.

10. An electrical connector assembly for mounting to contact pads on a printed circuit board (PCP), said connector assembly comprising:

a carrier plate:

a first connector component attached to said carrier plate, said first connector being a component of a complete electrical connector when mated with a second connector component; and a frangible connection between said first connector components such that after mounting said connector assembly to the PCB, said carrier plate is detached from said first connector component;

wherein said first connector component comprises an insulative base body, said frangible connection comprising a weakened material line between said carrier plate and said insulative base body;

wherein said carrier plate and said insulative base body is molded as a single component.

11. The connector assembly as in claim 10, wherein said carrier plate comprises a generally L-shaped member with a first leg defining an upper surface with a surface area sufficient for attachment of a suction nozzle of vacuum transfer device, and a second leg extending transversely to said insulative base body.

12. The connector assembly as in claim 10, wherein said first connector component is a component of a single way connector when mated with a complimentary second connector component of an adjacent PCB, such that each said connector assembly provides separate components of different single way connectors.

13. The connector assembly as in claim 12, wherein said first connector component is one of a socket component or a plug component.

* * * * *

UNITED STATES PATENT AND TRADEMARK OFFICE

CERTIFICATE OF CORRECTION

PATENT NO. : 8,727,790 B1
APPLICATION NO. : 13/666405
DATED : May 20, 2014
INVENTOR(S) : Peter Bishop It is certified that error appears in the above-identified patent and that said Letters Patent is hereby corrected as shown below:

ON THE TITLE PAGE

Item (57) under "Abstract", line 2, delete "(PCP)" and insert -- (PCB) --

IN THE SPECIFICATION

Column 1, line 61, delete "(PCP)" and insert -- (PCB) --

Column 3, line 13, delete "ot" and insert -- of --

Column 3, line 59, delete "(PCP)" and insert -- (PCB) --

IN THE CLAIMS

Column 6, line 39, claim 1, delete "(PCP)" and insert -- (PCB) --

Column 8, line 5, claim 10, delete "(PCP)" and insert -- (PCB) --

Signed and Sealed this
Thirtieth Day of December, 2014

Michelle K. Lee

Michelle K. Lee
*Deputy Director of the United States Patent and Trademark Office*